US006323591B1

(12) United States Patent
Oosterhout et al.

(10) Patent No.: US 6,323,591 B1
(45) Date of Patent: Nov. 27, 2001

(54) CRT WITH SPECIFIC ENVELOPE THICKNESS

(75) Inventors: Gerardus M. Oosterhout; Peter M. Bruisten; Paul F. A. Sterken; Petrus R. M. Schoone, all of Eindhoven; Maarten A. Zwikker, Margraten; Jan W. Kleine; Jan P. Van Den Brink, both of Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/259,963

(22) Filed: Mar. 1, 1999

(30) Foreign Application Priority Data

Mar. 9, 1998 (EP) ..... 98200745

(51) Int. Cl.[7] ..... H01J 31/00
(52) U.S. Cl. ..... 313/477 R; 313/634
(58) Field of Search ..... 313/364, 461–477 R, 313/634

(56) References Cited

U.S. PATENT DOCUMENTS 5,115,163 * 5/1992 Fitzpatrick et al. ..... 313/36
5,155,411 * 10/1992 Swank et al. ..... 313/477 R
5,258,688 * 11/1993 Fondrk ..... 313/477 R
5,751,103 * 5/1998 Opresko et al. ..... 313/477 R

FOREIGN PATENT DOCUMENTS

WO9807174 2/1998 (WO) ..... H01J/29/86

* cited by examiner

*Primary Examiner*—Vip Patel
(74) *Attorney, Agent, or Firm*—Norman N. Spain

(57) ABSTRACT

Picture display device with an evacuated tube comprising, around a longitudinal axis, a display window, a conical portion and a neck portion, said conical portion being connected to an upstanding wall of the display window. The wall thickness of the conical portion is selectively reduced. In particular, the wall thickness in an area of the conical portion is substantially constant.

8 Claims, 4 Drawing Sheets

CRT WITH SPECIFIC ENVELOPE THICKNESS

BACKGROUND OF THE INVENTION

The invention relates to a picture display device comprising a display tube having an evacuated envelope, which envelope comprises, around a longitudinal axis, a display window with a display screen on its inner side, a conical portion and a neck portion, the conical portion being connected to an upstanding wall of the display window.

The invention also relates to a conical portion for use in a picture display device.

Picture display devices of the type described in the opening paragraph are used, inter alia, in television apparatuses and computer monitors and are referred to as cathode ray tubes (CRTs).

A picture display device of the type described in the opening paragraph is known.

The known picture display device has some drawbacks, notably a large weight and high cost price of its conical portion.

SUMMARY OF THE INVENTION

It is an object of the invention to provide a picture display device in which said problem is alleviated.

To this end, the picture display device according to the invention is characterized in that the conical portion has a wall thickness, wherein the wall thickness $d_{sa}$ along a short axis of the conical portion as a function of a distance z in a first area of the conical portion adjacent to the upstanding wall of the display window is defined by the relation:

$$\delta d_{sa}/\delta z = C_1,$$

and, in a second area adjacent to the first area, is defined by the relation:

$$\delta d_{sa}/\delta z = C_2,$$

in which $|C_1|>|C_2|$, and in which the first area comprises a part of the conical portion for which $0 \leqq z \leqq a$, and the second area comprises a part of the conical portion for which $a \leqq z \leqq 80\%$, in which z represents a relative distance measured with respect to the projection on the longitudinal axis between the connection with the upstanding wall of the display window and the transition to at least substantially axial symmetry in the conical portion, and in which a is in the range of $10\% \leqq a \leqq 60\%$.

The conical portion is provided as a kind of linking element between the upstanding wall of the display window of the known picture display device, which upstanding wall usually has a relatively large wall thickness, and the neck portion which usually has a relatively small wall thickness, the wall thickness of the conical portion, measured from the upstanding wall towards the neck portion, generally decreasing linearly. In other words, in the known display device, the variation (direction coefficient) $\delta d_{sa}/\delta z$ of the wall thickness $d_{sa}$ along the short axis of the conical portion as a function of the relative distance z is constant across the conical portion. Hitherto, it has been assumed that such a linear variation of the wall thickness of the conical portion was necessary, both from a design point of view and for reasons of moldability. The inventors have recognized that such a linear variation is not necessary. Due to the measure according to the invention, the wall thickness of the conical portion in the first area undergoes a larger variation (decrease) than that in the second area. Consequently, a conical portion is obtained which comprises less material (glass) than the conical portion of the known picture display device. Due to the reduction of the quantity of material, the picture display device as a whole will be less heavy. A reduction in weight of picture display devices is notably important for those devices having a relatively large picture diameter because such apparatuses can otherwise be hardly lifted. The measure according to the invention may be used to advantage, notably for picture display devices having a large deflection angle (>100%). For picture display devices having such a large deflection angle, the tensions in the glass of the conical portion are relatively high. To compensate for such high tensions, thicker glass is generally used. Due to the measure according to the invention, such an increase of the quantity of material is not necessary in picture display devices having a large deflection angle (>100%). The weight reduction of the conical portion has the additional advantage that the picture display device as a whole thus has a lower cost price.

In this application, three main directions (see FIG. 2) are distinguished, namely the thickness variation of the conical portion along a cross-section of the conical portion parallel to the diagonal (to one of the corners of the display window), the thickness variation along a cross-section of the conical portion parallel to the short axis (to the upper and lower side of the display window), and the thickness variation along a cross-section of the conical portion parallel to the long axis (to the sides of the display window). The short axis is also referred to as "short cross-section" and the long axis is also referred to as the "long cross-section".

It is to be noted that $C_1$ and $C_2$ do not need to be constants but may be dependent on the relative distance z. Notably in the first area adjacent to the upstanding wall of the display window, a strong decrease of the wall thickness is preferably realized, so that in the second area, adjacent to the first area, the wall thickness in a direction remote from the display window does not decrease or hardly decreases. An embodiment of the picture display device according to the invention is characterized in that $|C_2| \leqq 0.02$. In the second area, the wall thickness $d_{sa}$ along the short axis as a function of the relative distance z is at least substantially constant, as measured with respect to the wall thickness in the first area. An alternative embodiment of the picture display device according to the invention is characterized in that the ratio between the variation of the wall thickness $d_{sa}$ in the second area, divided by the length of the second area, and the variation of the wall thickness $d_{sa}$ in the first area, divided by the length of the first area, is larger than 5. In this way, a considerable saving in weight of the conical portion is realized.

According to the invention, the value of the parameter a is in a range of $10\% \leqq a \leqq 60\%$. If $a \approx 10\%$, the first area is $0\% \leqq z \leqq 10\%$, in which the wall thickness d varies (decreases) to a relatively large extent, and relatively small with respect to the second area of $10\% \leqq z \leqq 80\%$ in which the wall thickness d varies (decreases) to a relatively small extent. If $a \approx 60\%$, the first area is $0\% \leqq z \leqq 60\%$, which is relatively large with respect to the second area of $60\% \leqq z \leqq 80\%$. Values for $a<10\%$ or $a>60\%$ are unfavorable for realizing material savings. The value for the parameter a is preferably in a range of $25\% \leqq a \leqq 50\%$. Notably in this range of the parameter a, the conical portion can be satisfactorily molded (at a relatively low molding force) and so-called folds are prevented when molding the conical portion. A particularly suitable value of the parameter is $a \approx 40\%$, at which a minimal molding force of the conical portion is realized.

An embodiment of the picture display device according to the invention is characterized in that the wall thickness $d_{sa}$ in the second area is defined by the relation $$0.9xd_{pa} \leqq d_{sa} \leqq 1.25xd_{pa},$$

in which $d_{pa}$ is a wall thickness of the conical portion at the area of the transition to at least substantially axial symmetry.

The upstanding wall of the display window generally has a non-axially symmetrical shape with respect to the longitudinal axis, whereas the neck portion of the picture display device usually has an axially symmetrical shape. Viewed from the display window, the conical portion has a shape in the first and the second area which is adapted to the symmetry of the display window (for example, an at least substantially fourfold symmetry) and has a transition to axial symmetry at an end portion of the second area remote from the display window.

By choosing the ratio of the wall thicknesses $d_{sa}/d_{pa}$ to be between 0.9 and 1.25 in the second area, a considerable saving of material for the conical portion is realized and a satisfactory moldability is achieved. Instead of the known linear decrease of the wall thickness, the wall thickness $d_{sa}$ has a size of the same order in the second area as the wall thickness $d_{pa}$ at the area of said transition to at least substantially axial symmetry. The wall thickness $d_{sa}$ for said part of the conical portion is preferably defined by the relation:

$$0.95xd_{pa} \leqq d_{sa} \leqq 1.10xd_{pa}.$$

Instead of the known linear decrease of the wall thickness, the wall thickness $d_{sa}$ along the short axis of the conical portion in said part of the conical portion is at least substantially equal to the wall thickness $d_{pa}$ at the area of said transition to at least substantially axial symmetry. This leads to a further saving of material for the conical portion.

In the known picture display device, the variation of the thickness of the conical portion is at least substantially equal for the various directions in which the neck portion is reached from the upstanding wall of the display window. In other words, the thickness distribution in the circumferential direction (measured by determining the section of the conical portion with projection planes perpendicular to the longitudinal axis) is usually constant along each of the three main directions (the short axis, the long axis and the diagonal) of the conical portion. The inventors have also recognized that a further saving of material (and hence a cost price reduction) of the conical portion is realized by allowing a suitable degree of the thickness variation along the various main directions. This further recognition may also be considered separately from the above-mentioned change of the direction coefficient $\delta d_{sa}/\delta z$ at the interface of the first and the second area. To this end, an embodiment of the picture display device according to the invention is characterized in that, in the second area, the ratio of a wall thickness $d_{diag}$ along a diagonal of the conical portion with respect to the wall thickness $d_{sa}$ along a short axis of the conical portion is defined by the relation:

$$1.2 \leqq d_{diag}/d_{sa} \leqq 1.6.$$

By using such a thickness variation in the circumferential direction of the conical portion, a considerable quantity of material is saved. Particularly suitable (also with a view to moldability of the conical portion) is a ratio value of $d_{diag}/d_{sa} \approx 1.4$. A similar ratio may also be given for the wall thickness $d_{la}$ along a long axis of the conical portion. In the second area, a wall thickness $d_{la}$ along a long axis of the conical portion is preferably defined by the relation:

$$d_{sa} \leqq d_{la} \leqq 1.10xd_{sa}.$$

A particularly suitable thickness variation in the circumferential direction of the conical portion, saving a considerable quantity of material, is obtained with a cone design for which, in the second area, $$d_{sa} \approx d_{pa},$$

$$d_{la} \approx 1.05xd_{sa},$$

$$d_{diag} \approx 1.4xd_{sa}.$$

Notably for these values of the ratio of the wall thicknesses in the circumferential direction, measured along the various main directions, a conical portion can be manufactured (molded) satisfactorily, while folds are prevented during the molding process.

BRIEF DESCRIPTION OF THE DRAWINGS

In the drawings.

The Figures are purely diagrammatic and not to scale. For the sake of clarity, some dimensions have been greatly exaggerated. Similar components are denoted as much as possible by identical reference numerals in the Figures.

DETAILED DESCRIPTION OF THE INVENTION

The invention will now be described in greater detail with reference to the figure of the drawings.

Figure 1:
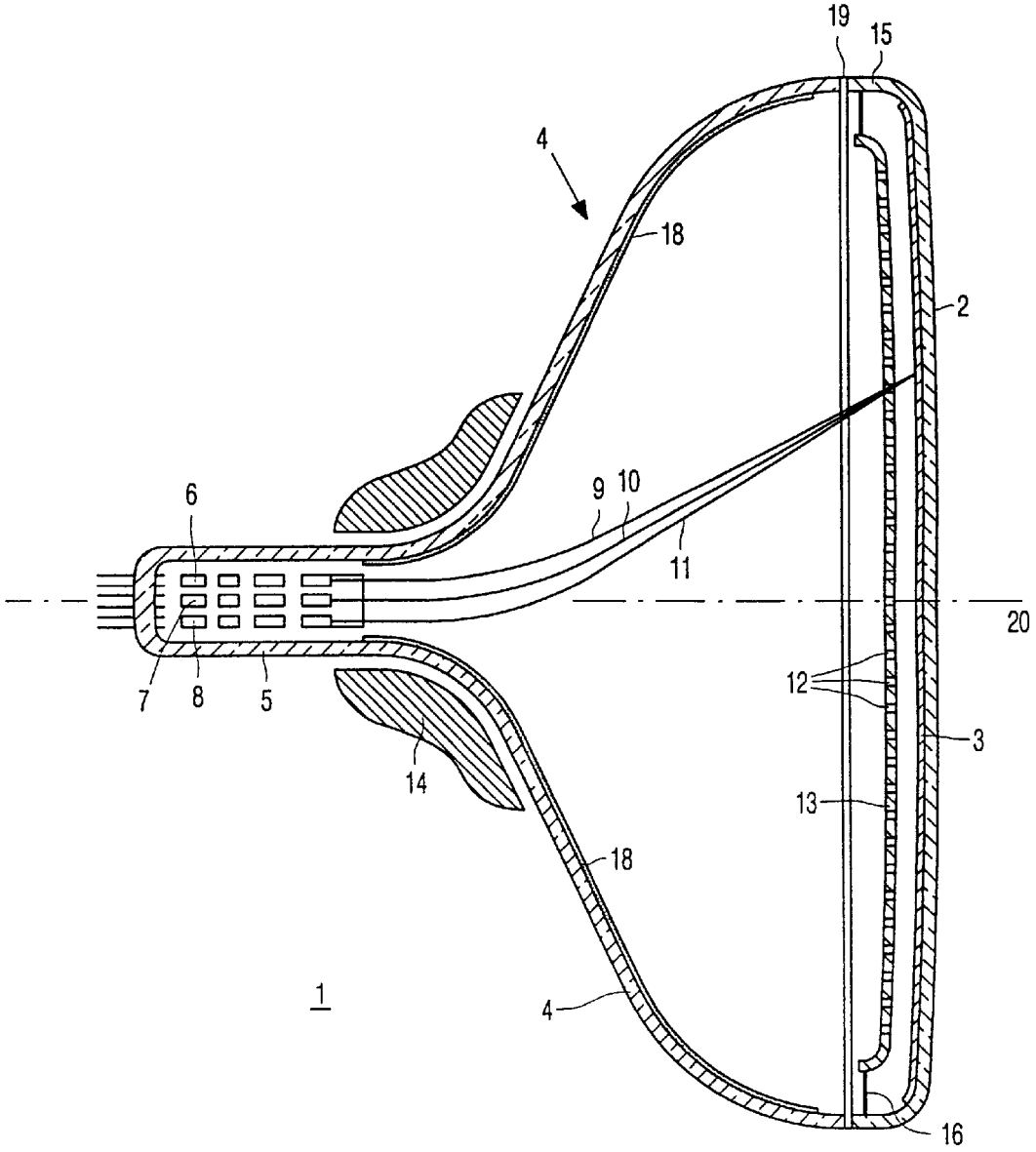
FIG. 1 is a cross-section of a picture display device comprising a cathode ray tube.

FIG. 1 is a diagrammatic cross-section of a picture display device comprising a cathode ray tube (CRT) having a longitudinal axis 20 and an evacuated envelope 1 comprising a display window 2, a conical portion 4 and a neck portion 5. A display screen 3 is provided on the inner surface of the display window 2. The display screen 3 comprises a large number of red, green and blue-luminescing phosphor elements. In this embodiment, the neck portion 5 comprises three electron guns 6, 7 and 8 for generating three electron beams 9, 10 and 11 which are usually situated in one plane, here the plane of the drawing. On their way to the display screen 3, the electron beams 9, 10 and 11 are deflected in two mutually perpendicular directions (a field and line deflection direction) by the deflection unit 14 across the display screen 3 and pass a color selection electrode 13 arranged in front of the display window 2, which electrode usually consists of a thin plate having apertures 12 and is referred to as shadow mask in this case. The color selection electrode 12 is suspended to the inner side of the upstanding wall 15 of the display window 2 with the aid of suspension means 16. The transition between the conical portion 4 and the upstanding wall 15 of the display window 2 is also referred to as the "seal edge" 19 where a (glass) frit is present, which frit serves as a sealing material. The three electron beams 9, 10 and 11 pass the apertures 12 of the color selection electrode 13 at different angles and thus each impinge on phosphor elements of one color only. The inner side of the conical portion 4 is usually coated with a conducting coating 18.

Figure 2:
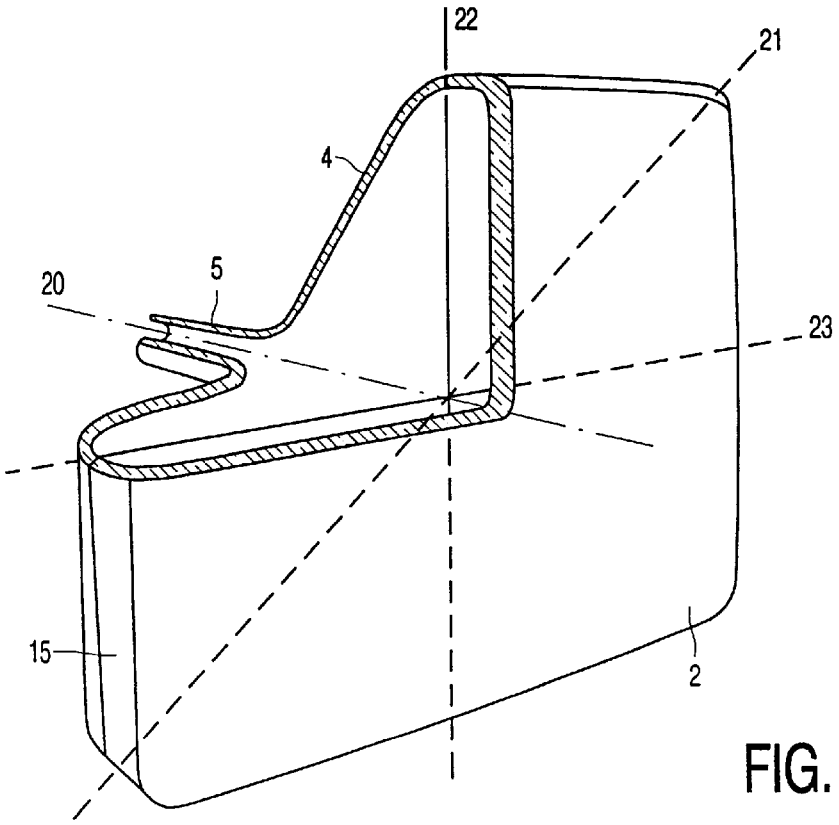
FIG. 2 is a perspective elevational view, partly broken away, of a part of the cathode ray tube of FIG. 2.

FIG. 2 is a perspective elevational view, partly broken away, of a part of the cathode ray tube of FIG. 2, with longitudinal axis 20, display window 2 and upstanding wall 15, conical portion 4 and neck portion 5. For the sake of clarity, some of the components shown in FIG. 1 have been omitted in this Figure. The thickness variation of the conical portion 4 is different for the various directions in which the upstanding wall 15 of the display window 2 is reached from the neck portion 5. Generally, three main directions can be distinguished, namely the thickness variation of the conical portion 4 along a cross-section of the conical portion 4 parallel to the diagonal 21 (to one of the corners of the display window), the thickness variation of the conical portion 4 along a cross-section of the conical portion 4 parallel to the short axis 22 (to the upper or lower side of the display window), and the thickness variation of the conical portion 4 along a cross-section of the conical portion 4 parallel to the long axis 23 (to the sides of the display window).

Figure 3:
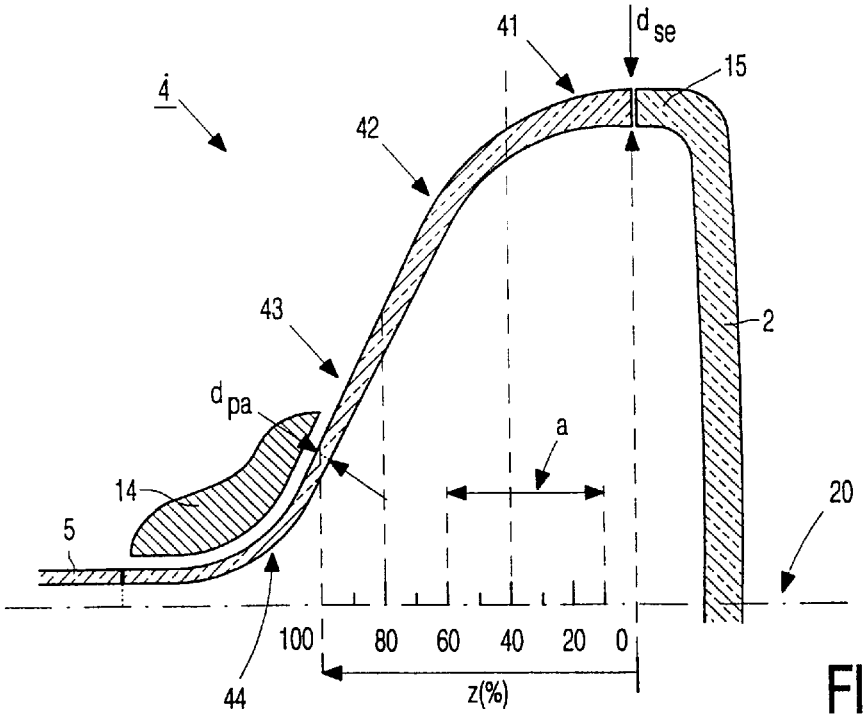
FIG. 3 shows an example of the contour of a conical portion of the cathode ray tube shown in FIG. 1.
Figure 4A:
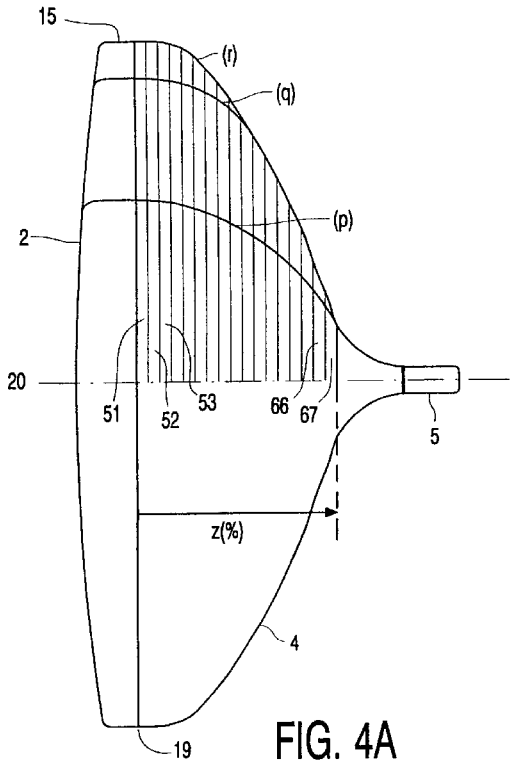
FIGS. 4A and 4B show examples of the contour of a cathode ray tube, measured along the diagonal, the long axis and the short axis.
Figure 4B:
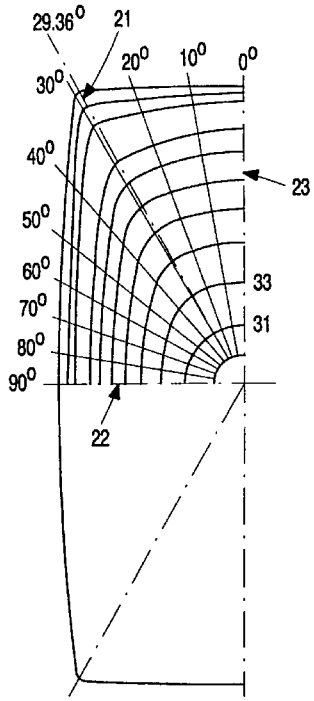

FIGS. 3, 4A and 4B show examples of the contour of a color picture display device. FIG. 3 is a side elevation of a part of a cathode ray tube with a longitudinal axis 20, a display window 2 and upstanding wall 15, a conical portion 4 and a neck portion 5. The relative distance z is measured with respect to the projection on the longitudinal axis 20 from the connection with the upstanding wall 15 of the display window 2 to the transition to at least substantially axial symmetry in the conical portion 4. In this application, the conical portion 4, viewed from the upstanding wall 15, is considered to be divided into four contiguous areas which are denoted by the reference numerals 41, 42, 43 and 44, respectively. The first area 41 of the conical portion 4 is bounded by $0 \leqq z \leqq a$, the second area 42 is bounded by $a \leqq z \leqq 80\%$, at which the value for the parameter a is in the range of $10\% \leqq a \leqq 60\%$. In this application, the parameter a is introduced so as to be able to choose the transition from the first to the second area at different values of the relative distance z in the design of the conical portion 4. In the preferred case, where a=40%, the first area 41 is bounded by $0 \leqq z \leqq 40\%$, and the second area 42 is bounded by $40\% \leqq z \leqq 80\%$. The third area 43 of the conical portion 4 has values of $80\% \leqq z \leqq 100\%$ for the relative distance, at which z=100% corresponds to the transition to at least substantially axial symmetry in the conical portion. The fourth area 44 comprises the part of the conical portion 4 between said transition to at least substantially axial symmetry and the transition to the neck portion 5 of the picture display device.

The upstanding wall 15 of the display window 2 generally has a relatively large wall thickness (typical thicknesses are 7–12 mm), whereas the neck portion 5 generally has a relatively small wall thickness (typical thicknesses are 3–6 mm). The wall thickness of the upstanding wall 15 is dependent on the diameter and the (glass) composition of the display window 2 and on requirements imposed on the permeability to X-rays of the material used. In the first area 41, the second area 42 and the third area 43, the conical portion 4 has a symmetry with respect to the longitudinal axis 20 adapted to the symmetry of the display window 2 (oriented with respect to the at least substantially rectangular shape of the display window 2; see also FIG. 2). In the fourth area 44, the conical portion 4 has an at least substantially axially symmetrical shape with respect to the longitudinal axis 20. The (at least substantially axially symmetrical) deflection unit 14 is generally arranged around this fourth area 44 of the conical portion 4. Often, the conical portion 4 at the area of the deflection unit 14 (area 44 ) is provided with ducts on its inner side so as to increase the effective deflection angle of the picture display device. Generally, the conical portion 4 in said fourth area 44 is perfectly round (circularly cylindrical), but in some picture display devices, the conical portion 4 in the fourth area 44 has a certain extent of out-of-roundness, with the deflection unit 14 being adapted thereto as regards shape. It is alternatively possible to implement the conical portion 4 in the fourth area 44 in a fourfold symmetry.

The transition in the conical portion 4 between the third area 43 and the fourth area 44 is characterized by a transition in the curvature of the conical portion to at least substantially axial symmetry, which transition (viewed from the neck portion 5) is also referred to as "top of round" by those skilled in the art. Said transition usually coincides with the end portion of the deflection unit 14 facing the display window 2 and referred to as the "outward flaring flange of the deflection unit 14 ". The relative distance z measured from the upstanding wall 15 of the display window 2 only covers the first, second and third areas (41, 42, 43 ) of the conical portion 4. The longitudinal axis 20 is scaled in percents by determining the section of the relevant conical portion 4 with projection planes perpendicular to the longitudinal axis 20. At the position on the longitudinal axis 20 corresponding to z=0%, the projection plane intersects the transition between the conical portion 4 and the upstanding wall 15, at z=100%, the projection plane intersects said transition to at least substantially axial symmetry (to the end portion of the deflection unit 14 facing the display window 2). In FIG. 3, the thickness $d_{se}$ is the wall thickness of the conical portion 4 at the area of the transition between the upstanding wall 15 of the display window 2 and the conical portion 4, indicated by z=0% on the longitudinal axis 20 in FIG. 3. Generally, $d_{se}$ is at least substantially equal to the wall thickness of the upstanding wall 15 at the area of the transition between the upstanding wall 15 and the conical portion 4. The thickness $d_{pa}$ is the wall thickness of the conical portion 4 at the area of the transition in the conical portion 4 to at least substantially axial symmetry (interface of the third area 43 and the fourth area 44 ), indicated by z=100% on the longitudinal axis in FIG. 4. Wall thicknesses of the conical portion 4, such as $d_{pa}$ and $d_{se}$, are measured perpendicularly to the curvature at the area of the wall (instead of in alignment with the projection plane perpendicular to the longitudinal axis).

In the example of FIGS. 4A and 4B, the display window 2 has a nominal screen diameter of 66 cm, the deflection angle is 106° and the aspect ratio is 16:9. Contour (p) in FIG. 4A shows the contour of the cathode ray tube, measured along the short axis (22), contour (q) shows the contour measured along the long axis (23) and contour (r) shows the contour measured along the diagonal (21) (see FIG. 4B).

Viewed from the upstanding wall 15 (seal edge 19) up to the transition to at least substantially axial symmetry in the conical portion, this conical portion is divided as a function of the relative distance z into a number of sections 51, 52, 53, . . . , 66, 67, (in this example: 17 sections), all of which sections have the same thickness with respect to the longitudinal axis 20. FIG. 4B shows the angle dependence of the contours of a number of sections 51, 52, 53, etc., as shown in FIG. 4A: along the longitudinal axis (23), the angle is 0°[contour(q)], along the short axis (22), the angle is 90° [contour(p)]; in this example, the angle along the diagonal direction is 29.36°[contour(r)]. Table I shows the maximum distances of the relevant sections as a function of the angle for each of the sections 51, 52, 53, etc., as shown in FIG. 4A. The side of section 51 facing the display window 2 is connected via the seal edge 19 to the upstanding wall 15 of the display window 2. It is apparent from Table I that for section 67, corresponding to the transition to axial symmetry (front end of the deflection unit), the distances to the longitudinal axis 20 are at least substantially equal for all angles. On the side of section 67 remote from the display window 2, the conical portion 4 is (perfectly) round: the distances of the section to the longitudinal axis 20 deviate by less than 5% as a function of the angle.

TABLE I

| Contour of a conical portion | | | | |
|---|---|---|---|---|
| | Nominal distance from section 51 | maximum distance from the the longitudinal axis (mm) | | |
| section | z (mm) | (p) 0° | (r) 29.36° | (q) 90° |
| 51 | 0 | 312.7 | 350.4 | 191.8 |
| 52 | 10 | 311.8 | 348.8 | 191.2 |
| 53 | 20 | 309.8 | 344.5 | 189.9 |
| 54 | 30 | 306.3 | 335.8 | 187.5 |
| 55 | 40 | 301.2 | 322.8 | 184.0 |
| 56 | 50 | 294.8 | 308.2 | 179.2 |
| 57 | 60 | 287.1 | 292.8 | 173.3 |
| 58 | 70 | 277.9 | 276.6 | 166.5 |
| 59 | 80 | 266.9 | 259.5 | 159.1 |
| 60 | 90 | 253.5 | 241.0 | 151.2 |
| 61 | 100 | 237.2 | 221.5 | 142.8 |
| 62 | 110 | 217.5 | 201.5 | 134.0 |
| 63 | 120 | 193.8 | 180.5 | 124.6 |
| 64 | 130 | 166.4 | 157.4 | 114.4 |
| 65 | 140 | 136.9 | 132.1 | 103.1 |
| 66 | 150 | 106.8 | 105.5 | 90.8 |
| 67 | 160 | 77.3 | 77.3 | 77.5 |

Figure 5:
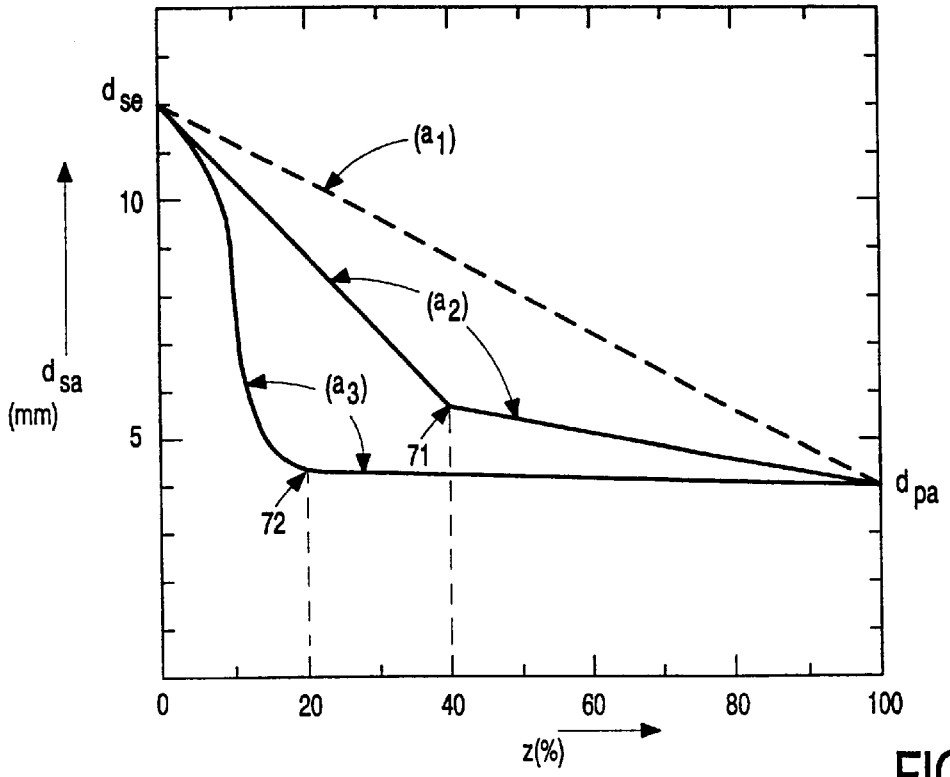
FIG. 5 shows a graph of the wall thickness $d_{sa}$ of the conical portion as a function of the relative distance measured along the short axis, in a direction from the upstanding wall of the display window to the transition to at least substantially axial symmetry in the conical portion.

FIG. 5 shows a graph of the wall thickness $d_{sa}$ of the conical portion 4 as a function of the relative distance z measured along the short axis 22 in a direction from the upstanding wall 15 of the display window 2 to the transition to at least substantially axial symmetry in the conical portion 4. As shown above, $d_{se}$ corresponds to z=0% and $d_{pa}$ corresponds to z=100% (in the example of FIG. 5, $d_{se}$=12 mm and $d_{pa}$=4 mm). Curve ($a_1$) represents the (linear) variation of thickness in the conical portion 4 of the known picture display device. Curves ($a_2$) and ($a_3$) show examples of the decrease of thickness of the wall of the conical portion 4 according to the invention. In curve ($a_2$), there is a kink at z=40%, which kink is denoted by reference numeral 71 in FIG. 2 and at which the gradient of the wall thickness $\delta d_{sa}/\delta z$ changes. The position of the kink 71 is determined by the value of the parameter a in curve ($a_2$) and may be chosen in the range of $10 \leqq z \leqq 60\%$. With a view to the possibility of manufacturing (molding) the conical portion 4 and preventing folds during the molding process, it is desirable to situate the kink in curve ($a_2$) in the range of $10\% \leqq a \leqq 60\%$. A minimal molding force is realized at a value of the parameter a≈40%. An example of such a variation of the wall thickness of the conical portion 4 is shown in curve ($a_3$). In curve ($a_3$), the gradient of the wall thickness of the conical portion 4 is at least substantially constant for values of z≈20%, and the wall thickness $d_{sa}$ along the short axis is at least substantially equal to the wall thickness $d_{pa}$ at the area of the transition to at least substantially axial symmetry (z=100%). In curve ($a_3$), the direction coefficient of the wall thickness changes as a function of the relative distance z at z≈20% (denoted by reference numeral 72 in FIG. 5). In curve ($a_3$), there is a gradual change of the gradient of the wall thickness for values of $z \leqq 20\%$, so that a satisfactory transition between the conical portion 4 and the upstanding wall 15 of the display window 2 is realized.

Figure 6:
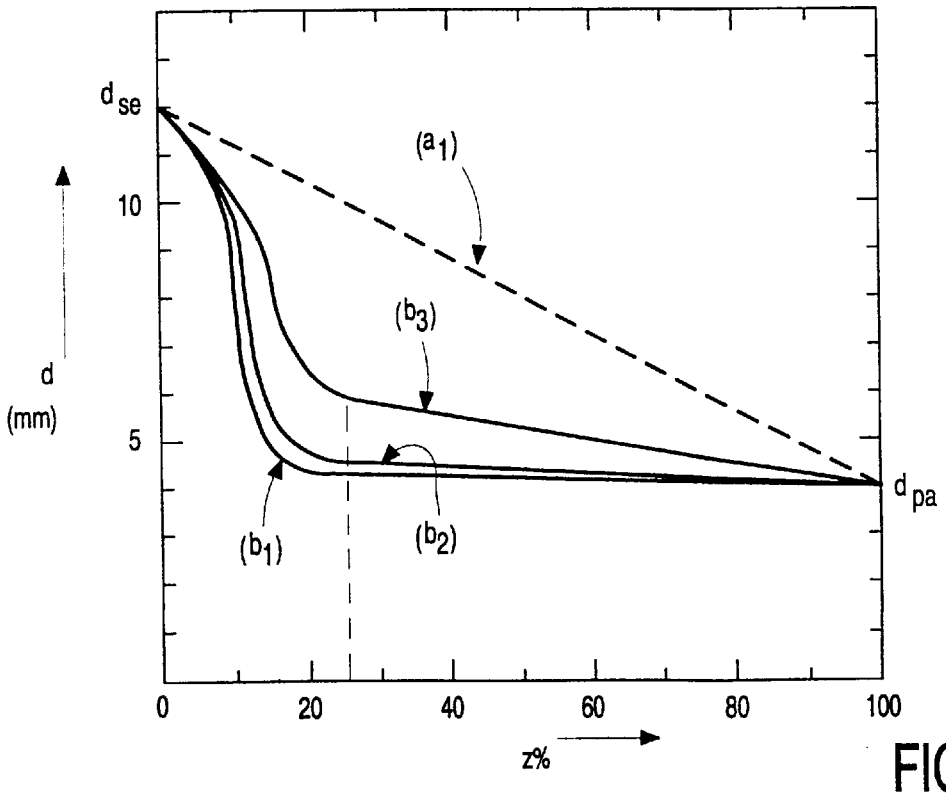
FIG. 6 shows a graph of the wall thickness $d_{sa}$, $d_{la}$ and $d_{diag}$ of the conical portion as a function of the relative distance, measured along the short axis, the long axis and the diagonal, in a direction from the upstanding wall of the display window to the transition to at least substantially axial symmetry in the conical portion.

FIG. 6 shows a graph of the wall thickness $d_{sa}$, $d_{la}$ and $d_{diag}$ of the conical portion 4 as a function of the relative distance z measured along the short axis 22, the long axis 23 and the diagonal 21, respectively, in a direction from the upstanding wall 15 of the display window 2 to the transition to at least substantially axial symmetry in the conical portion 4. At z=0% and z=100%, the wall thickness $d_{sa} \approx d_{la} \approx d_{diag} \approx d_{pa}$. Curve ($a_1$) represents the (linear) thickness variation in the conical portion 4 of the known picture display device (see also FIG. 5). Curves ($b_1$), ($b_2$) and ($b_3$) show examples of the decrease of thickness of the wall of the conical portion 4 in the three main directions according to the invention. Curve ($b_1$) shows the decrease of thickness of the wall along the short axis 22 of the conical portion 4, curve ($b_2$) shows the decrease of thickness along the long axis 23 and curve ($b_3$) shows the decrease of thickness along the diagonal 21. In curves ($b_1$), ($b_2$) and ($b_3$), there is a kink at z≈25%, at which kink the gradient of the wall thickness $\delta d_{sa}/\delta z$, $\delta d_{la}/\delta z$ and $\delta d_{diag}/\delta z$ changes. In the curves ($b_1$), ($b_2$) and ($b_3$), the gradient of the wall thickness of the conical portion 4 is at least substantially constant for values of $z \geqq 25\%$, and the wall thickness $d_{sa}$ along the short axis is at least substantially equal to the wall thickness $d_{pa}$ at the area of the transition to at least substantially axial symmetry (z=100%). In the curves ($b_1$), ($b_2$) and ($b_3$), there is a gradual change of the wall thickness gradient for values of $z \leqq 25\%$, so that a satisfactory transition between the conical portion 4 and the upstanding wall 15 of the display window 2 is realized.

In FIGS. 5 and 6, the curves ($a_2$), ($a_3$) and the curves ($b_1$), ($b_2$) and ($b_3$) are situated below curve ($a_1$): the area enclosed by the afore-mentioned curves illustrates the saving of material for the conical portion. Such a reduction of required material leads to a considerably lower cost price of the picture display device. A measure of the material saving for the conical portion 4 is the weight of this portion. For example, a conical portion 4 of a picture display device having a screen diameter of 55 cm, with the wall thickness of the conical portion 4 decreasing similarly as in the known picture display device, and as described by curve ($a_1$) in FIG. 5, weighs 4.83 kg. A conical portion 4 according to the invention, whose wall thickness decreases as described by curve ($a_2$) in FIG. 5, weighs 3.88 kg. A conical portion 4 according to the invention, whose wall thickness decreases as described by curve ($a_3$) in FIG. 5, weighs 3.72 kg. In the latter case, the total weight of glass of a conical portion with respect to the conical portion of the known picture display device has decreased by approximately 25%.

It will be evident that many variations within the scope of the invention can be conceived by those skilled in the art. Generally, measures according to the invention, relating to the z direction (the "height" of the conical portion) lead to a reduction of the weight of the conical portion. Measures according to the invention, relating to the circumferential direction (sections of the conical portion with projection planes transverse to the z direction) lead to a satisfactory moldability or to an improved moldability of the conical portion.

What is claimed is:

1. A picture display device comprising a display tube having an evacuated envelope (1), which envelope comprises, around a longitudinal axis (20), a display window (2) with a display screen (3) on its inner side, a conical portion (4) and a neck portion (5), the conical portion (4) being connected to an upstanding wall (15) of the display window (2), characterized in that the conical portion (4) has a wall thickness, wherein the wall thickness $d_{sa}$ along a short axis (22) of the conical portion (4) as a function of a distance z in a first area (41) of the conical portion (4) adjacent to the upstanding wall (15) of the display window (2) is defined by the relation:

$$\delta d_{sa}/\delta z = C_1,$$

and, in a second area (42) adjacent to the first area (41), is defined by the relation:

$$\delta d_{sa}/\delta z = C_2,$$

in which $|C_1| > |C_2|$, and in which the first area (41) comprises a part of the conical portion (4) for which $0 \leqq z \leqq a$, and the second area (42) comprises a part of the conical portion (4) for which $a \leqq z \leqq 80\%$, in which z represents a relative distance measured with respect to the projection on the longitudinal axis (20) between the connection with the upstanding wall (15) of the display window (2) and the transition to at least substantially axial symmetry in the conical portion (4), and in which a is in the range of $10\% \leqq a \leqq 60\%$.

2. A picture display device as claimed in claim 1, characterized in that $|C_2| \leqq 0.02$.

3. A picture display device as claimed in claim 1, characterized in that the all thickness $d_{sa}$ in the second area (42) is defined by the relation $$0.9 x d_{pa} \leqq d_{sa} \leqq 1.25 x d_{pa},$$

in which $d_{pa}$ is a wall thickness of the conical portion (4) at the area of the transition to at least substantially axial symmetry.

4. A picture display device as claimed in claim 3, characterized in that the wall thickness $d_{sa}$ in the second area (42) is defined by the relation $$0.95 x d_{pa} \leqq d_{sa} \leqq 1.10 x d_{pa}.$$

5. A picture display device as claimed in claim 1, characterized in that, in the second area (42), the ratio of a wall thickness $d_{diag}$ along a diagonal (21) of the conical portion (4) with respect to the wall thickness $d_{sa}$ along a short axis (22) of the conical portion (4) is defined by the relation:

$$1.2 \leqq d_{diag}/d_{sa} \leqq 1.6.$$

6. A picture display device comprising a display tube having an evacuated envelope (1), which envelope comprises, around a longitudinal axis (20), a display window (2) with a display screen (3) on its inner side, a conical portion (4) and a neck portion (5), the conical portion (4) being connected to an upstanding wall (15) of the display window (2), characterized in that the conical portion (4) has a wall thickness, wherein the ratio of a wall thickness $d_{diag}$ along a diagonal (21) of the conical portion (4) with respect to a wall thickness $d_{sa}$ along a short axis (22) of the conical portion (4) in an area (42) of the conical portion (4) is defined by the relation $$1.20 \leqq d_{diag}/d_{sa} \leqq 1.6,$$

in which the area (42) comprises a part of the conical portion (4) for which $a \leqq z \leqq 80\%$, in which z represents a relative distance measured with respect to the projection on the longitudinal axis (20) between the connection with the upstanding wall (15) of the display window (2) and the transition to at least substantially axial symmetry in the conical portion (4), and in which a is in the range of $10\% \leqq a \leqq 60\%$.

7. A picture display device as claimed in claim 6, characterized in that, in said area (42), the wall thickness $d_{sa}$ is defined by the relation:

$$0.9 x d_{pa} \square d_{sa} \square 1.25 x d_{pa},$$

in which $d_{pa}$ is a wall thickness of the conical portion (4) at the second area.

8. A conical portion of an evacuated envelope of a display tube which envelope comprises, around a longitudinal axis, a display window with a display screen on its inner side, a conical portion and a neck portion, the conical portion being connected to an upstanding wall of the display window, characterized in that:

The conical portion has a wall thickness, wherein the wall thickness $d_{sa}$ along a short axis of the conical portion as a function of a distance z in a first area of the conical portion adjacent to the upstanding wall of the display window is defined by the relation:

$$d_{sa}/z = C_1,$$

and, in a second area adjacent to the first area, is defined by the relation:

$$d_{sa}/z = C_2,$$

in which $C_1 > C_2$, and in which the first area comprises a part of the conical portion for which $0 \leqq z \leqq a$ and the second area comprises part of the conical portion for which $a \leqq z \leqq 80\%$, in which z represents a relative distance measured with respect to the projection on the longitudinal axis between the connection with the upstanding wall of the display window and the transition to at least substantially axial symmetry in the conical portion, and in which a is in the range of $10\% \leqq a \leqq 60\%$.

* * * * *